United States Patent [19]

Wesley

[11] 4,092,204

[45] May 30, 1978

[54] APPARATUS FOR LABELING YARN SKEINS

[75] Inventor: James G. Wesley, Berwyn, Ill.

[73] Assignee: Labelette Company, Forest Park, Ill.

[21] Appl. No.: 755,196

[22] Filed: Dec. 29, 1976

[51] Int. Cl.[2] ..... B65C 9/26

[52] U.S. Cl. ..... 156/481; 156/492; 156/DIG. 37

[58] Field of Search ..... 156/492, 481, 212, 215, 156/218, 477 R, DIG. 37, DIG. 41, DIG. 42

[56] References Cited

U.S. PATENT DOCUMENTS

| | | | |
|---|---|---|---|
| 2,179,264 | 11/1939 | Lobasso | 156/481 |
| 3,278,359 | 10/1966 | Wesley | 156/356 |
| 3,822,163 | 7/1974 | Bilotti | 156/492 X |

*Primary Examiner*—William A. Powell
*Assistant Examiner*—William H. Thrower
*Attorney, Agent, or Firm*—McWilliams & Mann

[57] ABSTRACT

An apparatus for labeling skeins of yarn or the like comprising a processing way that includes a label supply station, a labeling station, and an apparatus for feeding individual labels from the supply station to the labeling station. The labeling station includes a plurality of pairs of oppositely acting swing arms, with which the label as supported at the labeling station is centered, with the arms of each pair of arms including a first swing arm on the label infeed side of the labeling station and a second swing arm on the opposite side of the labeling station. The swing arms of each pair project from rock shafts extending transversely of the way, and the swing arms at their projecting ends are of semi or open loop shape for cooperatively encompassing the skein to be labeled.

The label infeed side swing arms of each pair of such arms are simultaneously actuated to move to their extended positions whereby to wrap the label trailing end across the label infeed side of the skein to dispose the glue bearing terminal end portion of the label trailing end in upwardly facing relation, after which the other arms of each pair of swing arms are simultaneously moved to their operative positions to wrap the leading end of the label over the top of the skein and bring same against the trailing end of the label. Thereafter, the pressure foot is brought against the label leading end to press both label ends against the skein upper side to adhere the label ends together across the glue coated surfaces of the label.

3 Claims, 11 Drawing Figures

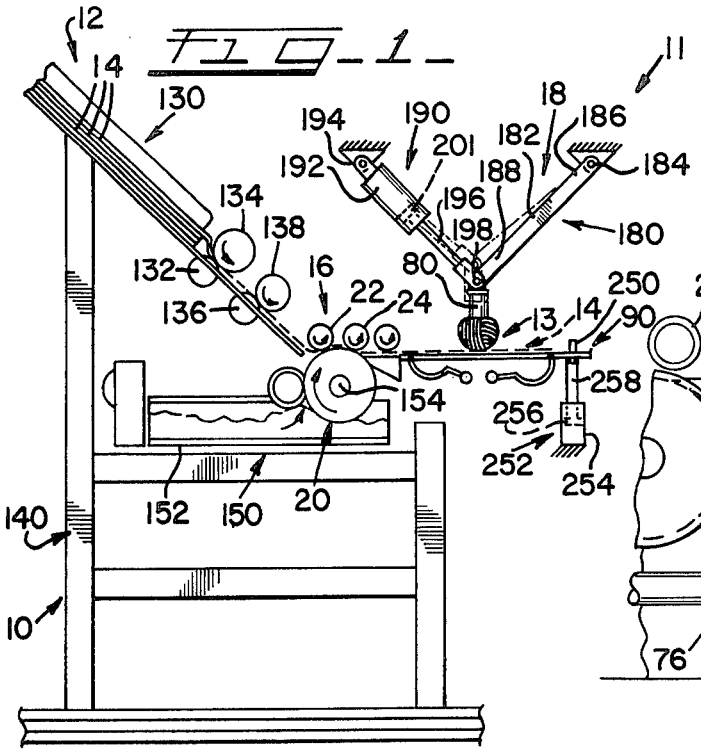
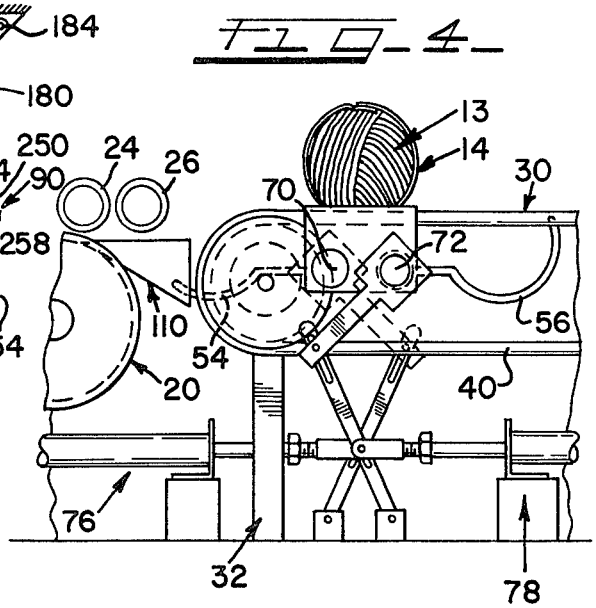
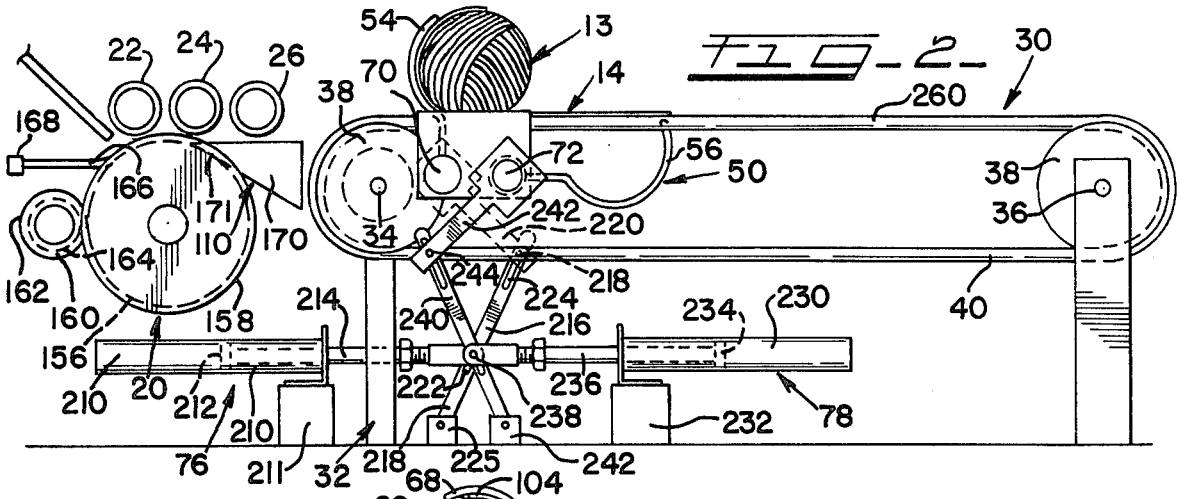
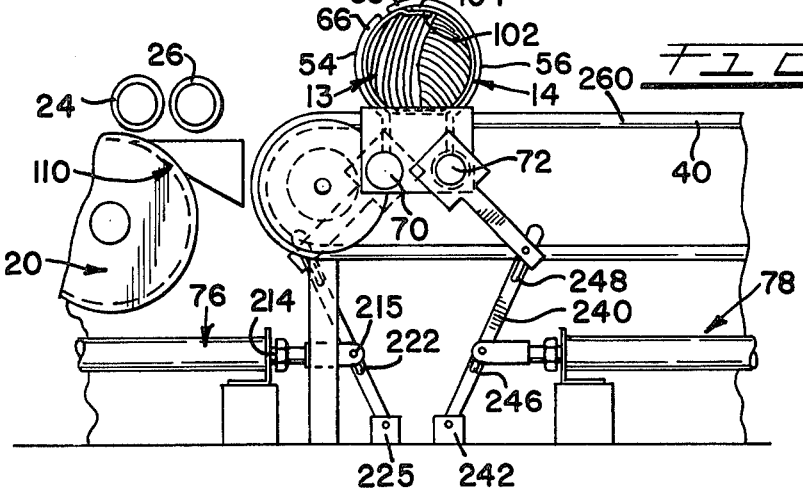
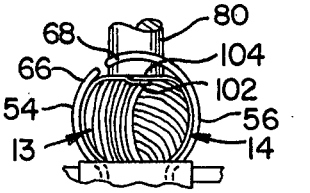
FIG. 3A

FIG. 7
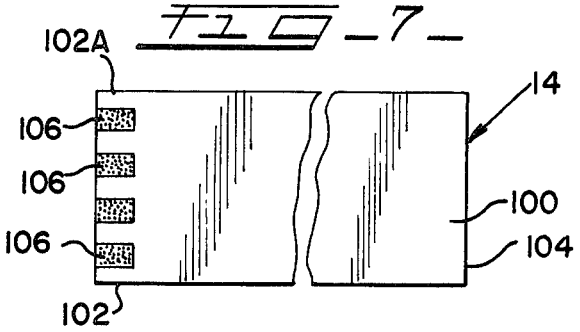
FIG. 8
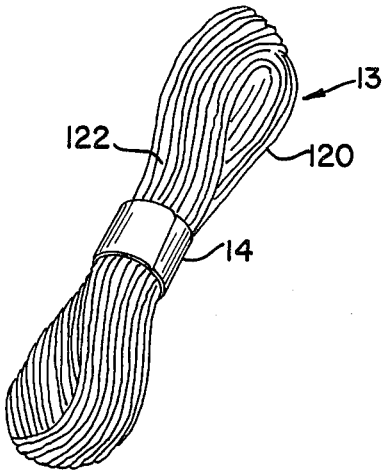
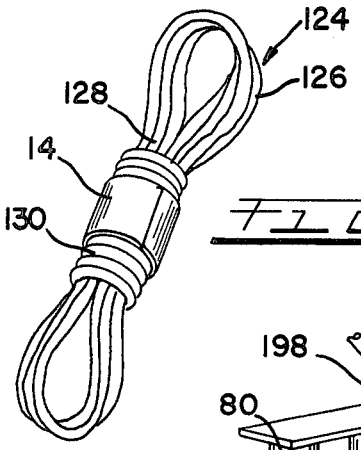
FIG. 9
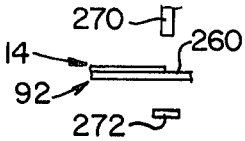
FIG. 5
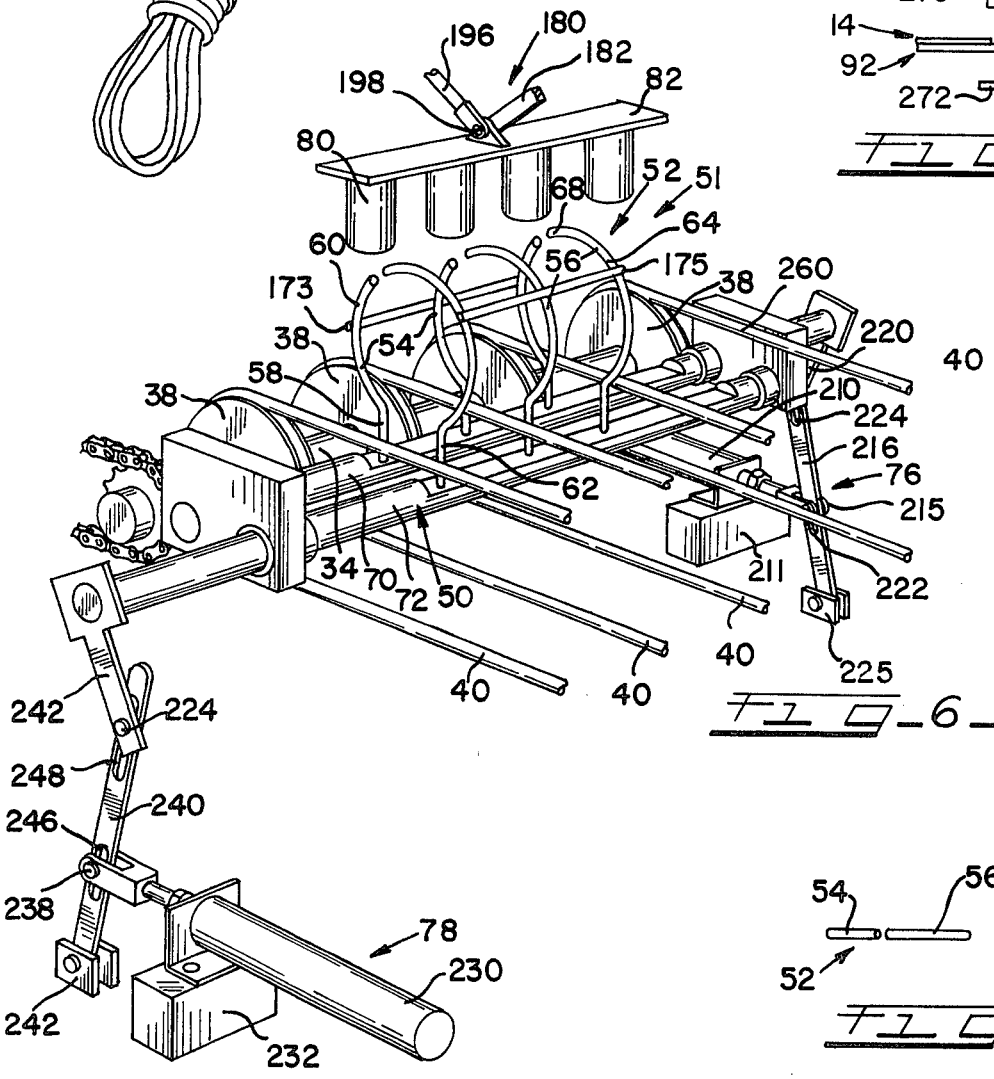
FIG. 6
FIG. 10

APPARATUS FOR LABELING YARN SKEINS

This invention relates to an apparatus for applying labels to yarn skeins and the like, and more particularly, to an apparatus for applying the label in encompassing relation about the shank of the skein.

Yarn sold at retail for knitting purposes and the like is commonly supplied in a skein or hank form in which the coils have a pair of their opposite sides brought together to form a shank about which a label is applied to keep the coils assembled, and to provide the desired product identification and trademark indicia. Application of labels to yarn skeins and the like is complicated by the fact that the glue that is to bond the label ends together must not be applied to the underside of the label where it would soil the product involved.

A principal object of the present invention is to provide an apparatus for labeling yarn skeins with a single label wrapped about the skein shank and the label ends bonded together in overlapping relation.

Another principal object of the invention is to provide apparatus for labeling skeins of yarn and the like about their shanks that permits a single worker to effectively accomplish the labeling on a mass production basis with minimal handling of the skeins.

Other objects of the invention are to provide a skein label applying apparatus that is of few and simple parts, that may be integrated with conventional label supplying machines, and to provide a skein labeling machine that is economical of manufacture, and that is convenient, effective, and long lived in use.

In accordance with the present invention, an apparatus is provided comprising a processing way which includes a label supply station, a labeling station, and an apparatus for feeding individual labels from the supply station to the labeling station. The labeling station includes a support to which the label to be applied to the skein is applied at a predetermined position, with the skein to be labeled to be placed by the machine operator on the label in centered relation thereto.

In being supplied to the labeling station, the label is disposed so that its indicia bearing or front sides faces downwardly, and the label has applied to the trailing edge of same, at a limited area on the label front side adjacent the label trailing end, the bonding glue that is required to bond the label ends together.

The labeling station includes a plurality of pairs of oppositely acting swing arms with which the label as supported at the labeling station is centered. The arms of each pair of swing arms include a first swing arm on the label infeed side of the labeling station, and a second swing arm on the opposite side of the station.

The swing arms of each pair of swing arms project from rock shafts extending transversely of the way, and at their projecting ends the swing arms are of semi or open loop shape for cooperatively encompassing the skein to be labeled when moved in planes paralleling the way from retracted inoperative positions below the level of the supported label to operative extended positions cooperatively encompassing the skein, to thereby wrap or lay the label ends against and over the skein and bring the label ends in contact for bonding of such label ends together.

A cooperating pressure foot mounted for movement against the upper portion of the skein is provided to complete the bonding of the overlapped ends together.

After the label is positioned for labeling at the labeling station, the skein is rested on same in centered relation thereof and with respect to the swing arms, with the skein extending crosswise of the way. The first or label infeed side swing arms of each pair are simultaneously actuated to move to their operative positions whereby the label trailing end is wrapped or laid up and over the top of the skein to dispose the glued terminal end portion of the label trailing end in upwardly facing relation after which the other arms of each pair of arms are simultaneously actuated to move to their operative positions to wrap or lay the leading end of the label over the top of the skein and bring it against the label trailing end, and in particular the glue bearing portion of same. Thereafter, the pressure foot is brought against the overlapped label ends to press same against the skein upper side to effect full bonding of the label ends together. On reaction of the pressure foot, the skein shank returns to rounded shaping, and thus distends lightly against the label inside surfacing to establish a firm holding action of the label to the shank. On opening of the swing arms to their inoperative positions, the freshly labeled skein is removed and replaced by another skein to be labeled.

Other objects, uses, and advantages will be obvious or become apparent from a consideration of the following detailed description and the application drawings in which like reference numerals indicate like parts throughout the several views.

In the drawings:

FIG. 1 is a side elevational view largely in block diagram form illustrating the general arrangement of the apparatus comprising the invention;

FIG. 2 is a view similar to that of FIG. 1, but more specific to the labeling station of the apparatus and associated parts, with a yarn skein shown in the process of being labeled;

FIG. 3 is a view similar to that of FIG. 2 but showing the label as wrapped or laid around the yarn skein by the swing arms that operate at the labeling station;

FIG. 3A is a fragmental view similar to that of FIG. 3 but showing the overlapped label ends pressed against the skein for effecting full bonding of same together.

FIG. 4 is a view similar to that of FIGS. 2 and 3 but showing the swing arms retracted and the labeled skein ready for removal;

FIG. 5 is a fragmental view illustrating a varient form of the invention;

FIG. 6 is a perspective view diagrammatically illustrating the principal components of the apparatus at the labeling station;

FIG. 7 is a plan view of the indicia bearing side of a label to be processed by the invention, with the label bearing the glue in the manner that the label is presented to the labeling station;

FIG. 8 is a perspective view of a yarn skein after having been labeled in accordance with the invention;

FIG. 9 is a quantity of rope made up in skein form that has been labeled in accordance with the practice of the invention; and FIG. 10 is a diagrammatic top plan view of one of the pairs of labeling station label wrapping swing arms indicating a positional relationship involved.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 10 of FIG. 1 generally indicates a diagrammatically illustrated embodiment of the invention which comprises a processing way 11 including a label supply station 12 at which a supply of labels 14 are supported for separation and feeding one by one past a glue station 16 where the glue is applied to the individual labels at the location on the label indicated in FIG. 7, after which the individual labels are moved to a labeling station 18 for individual application to separate yarn skeins 13 (see FIG. 8).

The label supply station 12 and the glue station 16 may be arranged in accordance with prior U.S. Pat. No. 3,278,359 (the entire disclosure of which is incorporated herein by this reference), and thus the glue station 16 comprises a glue roller 20 and associated parts which are arranged for skip glue type glue application to the individual labels following the principles set forth in said patent. Operatively associated with the glue roller 20 are guide rollers 22 and 24 from which the label being supplied to the station 18 passes to a feed roller 26 which feeds the label in question onto conveyor 30 for movement into the station 18.

The labeling station 18 generally comprises, in the specific form that is diagrammatically illustrated, an endless band type conveyor 30 mounted on a suitable frame 32 in which shafts 34 and 36 are journaled. The shafts 34 and 36 have keyed thereto a plurality of pulleys 38 with the individual pairs of pulleys 38 arranged in coplanar pairs, and with the individual pairs of pulleys 38 each having trained over same an endless band 40, as more specifically indicated in FIG. 6.

The conveyor 30 in this embodiment of the invention provides the support for the label 14 and skein 13 to be labeled thereby during the labeling operation, and also serves to move the labeled skein 13 away from the machine operator in preparation for the next labeling operation.

The labeling station 18 also includes a swing arm assembly 50 which comprises a plurality of pairs of swing arms 52 of which each pair 52 comprises a shorter swing arm 54 on the label infeed side of the station 18 and a longer swing arm 56 on the other side of such station. The swing arm pairs 52 form a set 51 of such swing arms for assembly 50.

The swing arms 54 and 56 are of semi or open loop, "question mark", configuration. The swing arms 54 each comprise a rectilinear of straight shank portion 58 and an arced end portion 60 while the swing arms 56 each comprise a rectilinear or straight shank portion 62 and an arced end portion 54. The arced end portions 60 and 64 are struck on the same radius and are proportioned to have the length differential indicated in FIG. 3 whereby the terminal end portions 66 and 68 of the swing arms 54 and 56 making up a pair of swing arms 52 are in closely spaced relation when the swing arms 54 and 56 have both been moved to their operative positions of FIG. 3.

The swing arms 54 are mounted in rock shaft 70 while the swing arms 56 are mounted in separate rock shaft 72. The rock shafts 70 and 72 are suitably journaled in frame 32 for pivotal movement between the positions indicated in FIGS. 2, 3 and 4, under the action of suitable air cylinder devices 76 and 78.

As indicated in FIG. 10, the swing arms 54 and 56 of each pair 52 are shaped to lie in their respective planes. The swing arms 54 and 56 of each pair are applied to their respective rock shafts 70 and 72 with the orientation that their planes are coplanar and extend longitudinally of the conveyor 30 and processing way 11. Operatively associated with labeling station 18 is pressure foot 82 that functions to flatten the yarn skein 13 during the operation of the swing arm assembly 50 so as to form a depressed, roughly flattened area along the top of the skein where the overlapped ends of the label being processed will be adhered together. Foot 82 is equipped with a plurality of pusher elements or studs 80 disposed to operate between the respective swing arm pairs 52 and on either side of the swing arm set 51. Swing arm pairs 52 are formed to expose portions of the label overlapped ends against which pusher elements or studs 80 engage and act to press the label overlapped ends against the skein 13.

The conveyor 30 is intermittently driven in timed relationship with the moving components of the label supply station, the gluing station 16, and labeling station 18 so as to be moving when a label 14 is in the process of being applied to the station 18, and to convey away labeled skeins, but to be stationary when a label 14 is in the process of being applied to a skein 13.

Operably associated with the conveyor 30 is a retractable stop device 90 against which the individual labels 14 are moved to preposition same for functioning of the apparatus at labeling station 18. The apparatus 10 is also equipped with a suitable sensing device 92 (see FIG. 5) for sensing the presence of the leading end of the label at its stopping point and effecting a stopping of the conveyor 30. As an alternate arrangement the device 90 may be eliminated and the device 92 relied on to dispose the label 14 in the desired predetermined position for skein labeling purposes.

In practicing the invention, the labels are applied to the label supply station 12 so that their indicia bearing sides will face downwardly. When a skein 13 is to be labeled, the apparatus is operated to supply a label 14 from the labeling station 12 which passes through the glue applying station 16 for application to the indicia bearing side 100 of same (see FIG. 7), and at the trailing end 102 of the label, as distinguished from its leading end 104, a limited amount of glue at the spaced areas 106, which areas are limited to the terminal end portion 102A of the label end 102.

The guide rollers 22 and 24 and the movement of glue roller 20 bring the label 14 being processed to and across guide device 110 and under feed roller 26 which moves the label 14 being processed onto conveyor 30 for movement to the predetermined labeling position indicated in FIG. 2. Movement of the label is stopped either by operation of the positive stop device 90, if present, or the sensing device 92 in performing its function of controlling conveyor 30.

At this point in the operation of the machine 10, the swing arm assembly 50 has its swing arms 54 and 56 disposed in their retracted inoperative positions shown in FIGS. 1 and 4, at which position the swing arms 54 and 56 will be disposed below the support level of label 14 as supported by the conveyor 30, so that there is complete freedom of movement provided for with regard to the prepositioning of the label 14 at the labeling station 18.

The operator now grasps a yarn skein 13 to be labeled (assuming a suitable quantity of skeins to be labeled is disposed conveniently available to the operator), and places the skein 13 in question crosswise of the way 11 and conveyor 30 at the station 18 and in vertical alignment with the rock shafts 70 and 72 for properly centering the skein with respect to the label 14 and the swing arm assembly 50.

The air cylinder actuating device 76 is then operated to swing the swing arms 54 from the position of FIGS. 1 and 4 to the position of FIG. 2, which effects a wrapping of the label 14 being processed up along the side of the skein on the label infeed side of same and station 18.

In this connection, as has been indicated, the swing arms 54 are of shorter length than swing arms 56, with the proportioning desired being indicated in FIG. 3. It is a feature of the invention that the length of the swing arms 54 and 56, and specifically their arcuate label engaging portions 60 and 64, be related to the length of the labels being handled such that the terminal end portions 66 of the swing arms 54 extend short of the label terminal end portion 102A that is to bear the glue, when the swing arms 54 are made operative to engage the label and swing its end 102 up over the upper portion of the skein being labeled. The result is that the label terminal end portion 102A will project outwardly of and beyond the terminal end portions 66 of the swing arms 54 when the swing arms 54 have reached their operative positions indicated in FIG. 3. Also, this results in the label terminal end portion 102A having been substantially inverted so that the glue bearing areas 106 are now facing generally upwardly.

The air cylinder device 78 is then operated to swing the swing arms 56 to their operative positions shown in FIG. 3, which results in the portion of the label 14 that is disposed on the right side of the skein (in the showings of FIGS. 1 – 4) being wrapped upwardly around the skein, over onto its top, with the label end 104 then being moved down against the upwardly facing glue bearing areas 106 of the label terminal end portion 102A for an initial bringing together of the label ends 102 and 104.

Operating suitable controls, the pressure foot 82 is then lowered against the now overlapped label ends 102 and 104 to press them against top of the skein (being labeled) sufficiently to form a flattened area across the top of such skein, as indicated in FIG. 2, after which the pressure foot 82 is withdrawn. This processing of the label effects firm adherence of the label ends together. On withdrawal of foot 82, the natural resiliency of the yarn material making up the skein 13 returns its shank shaping to that of FIG. 3.

The air cylinder mechanisms 76 and 78 are then operated to return the swing arm assembly 50 to its retracted relation indicated in FIG. 4, freeing the now labeled skein for removal from the station 18 to make room for the next skein labeling operation. The skein shank will now have distended sufficiently, under its inherent internal resiliency, to frictionally grip the label 14 against accidental displacement longitudinally of the skein shank.

In accordance with the illustrated embodiment, removal of the label skein 13 from station 18 is effected by actuating conveyor 30 to move the labeled skein to the right of FIGS. 1 – 4, where the labeled skeins may be discharged for further handling.

Alternately, the operator can himself pick up the labeled skein and place it in a suitable accumulating container or other conveyor conveniently located adjacent the operator.

Skeins 13 of yarn labeled in accordance with this invention are of the type diagrammatically illustrated in FIG. 8, and thus comprise the usual strand 120 of yarn coiled in the usual manner and having the opposite sides of the coils brought together to form the skein shank 122 about which the label 14 is applied in accordance with the invention.

The invention is also applicable to skeins of rope or the like, as indicated in FIG. 9, wherein the rope skein 124 comprises a length of rope 126 wound up in the usual coils and having opposite sides of the coils brought together to define a shank 128, which, in the form shown, is accomplished by a winding of part of the rope 126 about such shank, as indicated at 130. The skein 124 is thus appropriately contoured for labeling by machine 10 to provide same with a label 14.

SPECIFIC DESCRIPTION

The labeling station 12 may be arranged as disclosed in said U.S. Pat. No. 3,278,359 and involves the inclined adjustable hopper 130 in which a supply of the labels 14 are supported for separation and feeding one by one to and through glue station 16 in the manner described in said patent (which may be referred to for a specific disclosure of the labeling station and the operation of the various components of same). The rollers 132 and 134 correspond to the retard roller 49 and separating rollers 50 in said patent, while the rollers 136 and 138 correspond to the feed rollers 36 and 37 of said patent.

The guide rollers 22 and 24 are suitably journaled in the apparatus frame 140 and are suitably driven, such as in the manner suggested in said patent with regard to the corresponding rollers 62 and 32 of said patent. Feed roller 26 is similarly arranged and driven, and at the same surface speed.

The glue roller 20 is part of glue coater device 150 that is of the type disclosed in said patent, and which is only diagrammatically illustrated in the drawings of this application. The glue coater device 150 comprises a glue supply pan 152 suitably mounted on the machine frame 140 within which a supply of suitable glue is provided, with a glue coating roller 20 being suitably supported for rotation about axes 154 such that the lower portion of the rim of the glue roller 20 will run in the glue contained in pan 152. The glue roller 20 is formed to define a periphery having alternating grooves and ridges 156 and 158; operably associated with same is a groove clearing or cleaning roller 160 similarly provided with complementing grooves and ridges 162 and 164 that are intermeshed with the corresponding grooves and ridges of the roller 20 whereby the grooves of roller 20 are cleared from glue as the roller ridges 158 move upwardly and toward the glue coating position of the label 14 as it moves across the glue coating roller 20. Roller 20 is suitably journalled and driven in the direction indicated to have the same surface speed as rollers 22, 24 and 26.

Operably associated with the glue roller 20, following the disclosure of said U.S. Pat. No. 3,278,359, are a plurality of control fingers 166 that are disposed in each of the grooves 156 of the roller 20, and are mounted on a rock shaft 168 for elevation from a retracted position within the grooves of the roller 20 to a position where they are elevated somewhat above the roller ridges 158, whereby the label 14 that is passing across the glue roller 20 may have portions of same selectively elevated above or out of contact with the glue roller 20 (and specifically its glue bearing ridges 158) to provide the skip gluing control contemplated by said patent, and which in accordance with the present invention provides the restricted glue coated areas 106 on the printed side 100 of the label.

Operably associated with the rollers 20 and 26 is the guide device 110 that comprises a series of spaced guide plates 170 shaped to guide the leading edge 104 of the label 14 from glue roller 20 into engagement with the feed roller 26. The guide plates 170 are vertically disposed and mounted in any suitable manner for support by frame 140 in parallel spaced relation extending longitudinally of way 11, plates 170 are disposed to have their rearwardly projecting ends 171 disposed within grooves 156 of glue roller 20 for guiding relation with labels 14. The ends 66 of swing arms 54 operate between adjacent pairs of the plates 170.

The frame 140 may be of any suitable character, such as the general arrangement disclosed in my said patent.

As the length dimensions of the arcuate portions 60 and 64 of swing arms 54 and 56 are related to the length of the labels to be processed by machine 10, arms 54 and 56 are preferably removably mounted on their respective shafts 70 and 72 to be replaced by equivalent arms having the correct proportioning when the length of the labels to be processed is to be changed. Changing of the label length also involves readjusting the other functioning parts of the machine for timing purposes, which may be done in a manner similar to that described in said Patent.

In the form shown, swing arms 54 are joined together by brace rod 173 which swing arms 56 are joined together by brace rod 175.

The pressure foot 82 is part of the skein flattening device 180 which comprises swing arm 182 swingably and pivotally connected as at 184 to a suitable stationary support at its end 186, while its other end 188 is suitably fixed to the foot 82. The foot 82 is raised and lowered by air cylinder device 190 comprising air cylinder 192 pivotally connected as at 194 to a suitable stationary support and having its piston rod 196 pivotally connected to the foot as at 198. Reciprocation of the piston 200 within the cylinder 192 changes the effective length of the device 190 for raising and lowering of the foot 82.

Air cylinder device 76 comprises suitable air cylinder 210 mounted on suitable support 211 to be horizontally disposed and extend parallel to the way 11 and conveyor 30.

The air cylinder 210 reciprocably mounts piston 212 having its piston rod 214 pivotally connected as at 215 to rocker arm 216 which is in turn pivotally connected as at 218 to crank arm 220 of the rock shaft 70. As indicated in the drawings, the pivotal connections 215 and 218 illustrated involve the slotting of the rocker arm 216 as at 222 and 224 to provide the lost motion necessary because of the manner of mounting the rock arm 216 at pivotal connection 225.

Cylinder device 78 is arranged similarly to the device 76 and comprises suitable air cylinder 230 suitably mounted on suitable support 232 to be horizontally disposed and extend in parallelism to the way 11 and the conveyor 30. Air cylinder 230 reciprocably mounts piston 234 which has its piston rod 236 pivotally connected as at 238 to rocker arm 240 which in turn is pivotally connected to the crank arm 242 of rocker shaft 72 by pivotal connection 244. As in the case of rocker arm 216, the rocker arm 240 is slotted as at 246 and 248 to accommodate the lost motion necessary at the pivotal connections 238 and 244 by the manner of mounting of the rocker arm 240 at pivotal connection 242.

The stop device 90 comprises a vertically disposed stop member 250 that is vertically movable by being connected to air cylinder device 252 suitably mounted on frame 32 and comprising air cylinder 254 in which is reciprocably mounted piston 256 having its piston rod 258 suitably connected to stop member 250. Stop member 250 is disposed to be engaged, when in its extended position of FIG. 1, by the label 14 being moved into labeling position by conveyor 30. For instance, the stop member 250 is disposed in alignment with the middle set of swing arms 52, longitudinally of the conveyor 30, so that the label 14 will be contacting the stop member 250 at approximately its longitudinal center line.

When the labeling of the skein has been completed, the stop member 250 is retracted below the level of support of the label 14 so that the labeled skein may be moved to the right of FIGS. 1 - 4, on actuation of conveyor 30. As indicated, the label 14 and skein 13 are supported at the labeling station 18 on the conveyor 30, and specifically on the upper runs 260 of the bands 40 adjacent the portions of same running off pulleys 38. The bands 40 may be conveniently in the nature of pulley belts.

The sensing device 92 may be of any suitable type and in the form shown comprises a suitable light emitting source 270 directing a light beam on photosensitive receiver 272 between two adjacent bands 40 to one side of the location of the positive stop device 90, or, of course, in place of same so that as the label 14 moves to its predetermined labeling position, the light beam is interrupted by the label. The device 92 is suitably arranged to control the operation of conveyor 30 and thus stops same when the beam of the source 270 is interrupted.

The switching and other controls of the apparatus 10 may be integrated in a suitable control system, such as the one similar to that disclosed in said patent, to provide the timing relationships contemplated by the invention and suitable operator control. The arrangement is preferably such that for each skein to be labeled, the operator actuates the machine to move a label 14 to its predetermined position at station 18 whereupon the operator can place a skein at the centered location indicated with respect to the label and the swing arm assembly 50. As a fresh label is being glue coated and supplied to station 18, conveyor 30 operates to convey away a freshly labeled skein until the fresh label reaches its centered position relative to labeling station 18 and the conveyor 30 is stopped. The operation of sensing device 92 is arranged to directly control the operation of conveyor 30.

It will therefore be seen that the invention provides a method and apparatus for conveniently labeling yarn skeins and the like by applying a label about the shank of the skein. In practicing the invention, the side of the label that engages the skein (which functionally is the underside of the label) is completely free of glue and the application of the glue is confined to a limited area of the trailing end of the label on its normally outwardly facing side.

The label wrapping swing arms are arced to roughly complement the unstressed diameter of the skein shank, with the swing arm on the label infeed side of the labeling station being proportioned to be free of the surface area of the label that is glue coated, while permitting such area of the label to project away from same so as to be engaged by the other end of the label as the longer swing arms wrap the leading end of the label over the top of the skein.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. Apparatus for applying a label about the shank of a skein of yarn or the like, said apparatus comprising:

a processing way, said way including a labeling station, a label supply station, and means for feeding a label from said label supply station to said labeling station, said label supply station and said label feeding means being located relative to said way to dispose the label to extend and move longitudinally of said way, said label supply station including means for applying glue only to the underside of the label trailing end portion, said labeling station comprising:

a pair of swing arms each mounted for swinging movement about a horizontal axis extending transversely of said way and in planes extending longitudinally of said way, means for supporting a skein to be labeled above said axes, with the skein disposed tranversely of said way, means for centering the label supplied to said labeling station across said supporting means and with respect to said axes, said swing arms being of oppositely arched, semi-loop configuration with their loops lying in their respective swinging planes, said swing arms being movable between retracted inoperative positions on either side of and below the level of said supporting means ane extended operative positions encompassing a skein to be labeled that is placed on said supporting means for wrapping around the skein shank the label to be applied thereto, one of said swing arms being on the label infeed side of said labeling station and the other swing arm being on the opposite side of said station longitudinally of said way, means for sequentially swinging first said one swing arm from said inoperative position to said operative positon thereof and then said other swing arm from said inoperative position to said operative position thereof for bringing the label trailing and leading ends into overlapping relation to define a label overlapping portion extending longitudinally of said swing arm axes, said swing arms being formed to expose portions of the label overlapped portion lengthwise of said axes, and means for pressing the overlapped label ends against the shank of the skein for bringing the label ends into firm adherence, said pressing means comprising a pressure foot formed to engage against at least some of said label exposed portions and means for pressing said foot against the skein shank with said foot engaging said some label exposed portions, whereby the label trailing end is first wrapped against the skein shank to substantially invert the label trailing end portion over the skein shank, then the label leading end is wrapped against the skein shank and over the glue bearing label trailing end portion, and the label ends are pressed against the skein shank for adhering the label ends together.

2. Apparatus for applying a label about the shank of a skein of yarn or the like, said apparatus comprising:

a processing way, said way including a labeling station, a label supply station, and means for feeding a label from said label supply station to said labeling station, said label supply station and said label feeding means being located relative to said way to dispose the label to extend and move longitudinally of said way, said label supply station including means for applying glue only to the underside of the label trailing end portion, said labeling station comprising:

a pair of swing arms each mounted for swinging movement about a horizontal axis extending transversely of said way and in planes extending longitudinally of said way, means for supporting a skein to be labeled above said axes, with the skein disposed transversely of said way, means for centering the label supplied to said labeling station across said supporting means and with respect to said axes, said swing arms being of oppositely arced, semi-loop configuration with their loops lying in their respective swinging planes, said swing arms being movable between retraced inoperative positions on either side of and below the level of said supported means and extended operative positions encompassing a skein to be labeled that is placed on said supporting means for wrapping around the skein shank the label to be applied thereto, one of said swing arms being on the label infeed side of said labeing station and the other swing arm being on the opposite side of said station longitudinally of said way, means for sequentially swinging first said one swing arm from said inoperative position to said operative position thereof and then said other swing arm from said inoperative position to said operative position thereof for bringing the label trailing and leading ends into overlapping relation, and means for pressing the overlapped label ends against the shank of the skein for bringing the label ends into firm adherence, whereby the label trailing end is first wrapped against the skein shank to substantially invert the label trailing end portion over the skein shank, then the label leading end is wrapped against the skein shank and over the glue bearing label trailing end portion, and the label ends are pressed against the skein shank for adhering the label ends together, said one swing arm being proportioned to extend short of the label glue bearing trailing end portion when said one swing arm is in said operative position thereof, said other swing arm being proportioned to extend into close adjacency with said one swing arm over the skein shank when both said arms are in their said operative positions.

3. Apparatus for applying a label about the shank of a skein of yarn or the like, said apparatus comprising:

a processing way, said way including a labeling station, a label supply station, and means for feeding a label from said label supply station to said labeling station, said label supply station and said label feeding means being located relative to said way to dispose the label to extend and move longitudinally of said way, said label supply station including means for applying glue to the underside of the label trailing end only at the terminal end portion thereof, said labeling station comprising:

a plurality of pairs of swing arms with the arms of each pair mounted for swinging movement about a horizontal axis extending transversely of said way and in planes extending longitudinally of said way, means for supporting a skein to be labeled above said axes, with the skein disposed transversely of said way, means for centering the label supplied to said feeding means across said supporting means and with respect to said axes, said swing arms of each pair being of oppositely arced, semi-loop configuration, with their loops lying in their respective swinging planes, said swing arms of each pair being movable between retracted inoperative positions on either side of and below the level of said supporting means and extended operative positions cooperatively encompassing a skein to be labeled that is placed on said supporting means for wrapping around the skein shank the label to be applied thereto, one of said swing arms of each pair being on the label infeed side of said labeing station and the other swing arms of each pair being on the opposite side of said station longitudinally of said way, means for sequentially swinging against a label centered at said labeling station first said one swing arms from said inoperative positions thereof to said operative positions thereof and then said other swing arms from said inoperative positions thereof to said operative positions thereof to wrap the label trailing and leading ends about the skein shank into overlapped relation, and means for pressing the label overlapped ends against the shank of the skein for effecting firm adherence of said label ends together, whereby the label trailing end is first wrapped against the skein shank to substantially invert the label trailing end portion over the skein shank and then the label leading end is wrapped against the skein shank and over the glue bearing label trailing end portion for adhering the label ends together, said one swing arm of each pair thereof being proportioned to extend short of the label glue bearing portion when said one swing arm of said pairs is in said operative position thereof, said other swing arms of said pairs being proportioned to extend into close adjacency with said one swing arm of the respective pairs opposing it over the skein shank when both said arms of the respective pairs are in their said operative positions.

* * * * *